US007887983B2

(12) United States Patent
Sata et al.

(10) Patent No.: US 7,887,983 B2
(45) Date of Patent: Feb. 15, 2011

(54) PROCESS FOR PREPARING TONER FOR ELECTROPHOTOGRAPHY

(75) Inventors: Shinichi Sata, Wakayama (JP); Yoshinobu Ishikawa, Wakayama (JP); Nobumichi Kamiyoshi, Wakayama (JP)

(73) Assignee: Kao Corporation, Tokyo (JP)

( * ) Notice: Subject to any disclaimer, the term of this patent is extended or adjusted under 35 U.S.C. 154(b) by 513 days.

(21) Appl. No.: 11/199,220

(22) Filed: Aug. 9, 2005

(65) Prior Publication Data

US 2006/0051693 A1 Mar. 9, 2006

(30) Foreign Application Priority Data

Sep. 9, 2004 (JP) ..... 2004-262910

(51) Int. Cl.
*G03G 9/087* (2006.01)

(52) U.S. Cl. ..... 430/109.4; 430/137.14

(58) Field of Classification Search ..... 430/109.4, 430/137.1, 137.14
See application file for complete search history.

(56) References Cited

U.S. PATENT DOCUMENTS

| | | | | |
|---|---|---|---|---|
| 5,520,917 | A * | 5/1996 | Mizuguchi et al. | 424/401 |
| 6,254,990 | B1 * | 7/2001 | Ishizaki et al. | 428/402 |
| 7,579,129 | B2 * | 8/2009 | Kamiyoshi et al. | 430/111.4 |
| 2001/0046636 | A1 | 11/2001 | Daimon et al. | |
| 2002/0187415 | A1 * | 12/2002 | Jiang et al. | 430/137.14 |
| 2003/0003387 | A1 * | 1/2003 | Xu et al. | 430/137.14 |
| 2003/0091922 | A1 * | 5/2003 | Okado et al. | 430/111.33 |
| 2003/0104296 | A1 * | 6/2003 | Hamano et al. | 430/107.1 |
| 2004/0170440 | A1 * | 9/2004 | Hirobe et al. | 399/27 |
| 2004/0191656 | A1 * | 9/2004 | Ishiyama et al. | 430/106.1 |
| 2004/0191666 | A1 * | 9/2004 | Kamada et al. | 430/125 |
| 2005/0048389 | A1 * | 3/2005 | Cheng et al. | 430/108.3 |
| 2006/0210899 | A1 * | 9/2006 | Nakazawa et al. | 430/106.1 |

FOREIGN PATENT DOCUMENTS

| | | |
|---|---|---|
| JP | 6110252 | 4/1994 |
| JP | 10254171 | 9/1998 |
| JP | 2003255586 | 9/2003 |
| JP | 2004061875 | 2/2004 |
| JP | 2004225028 | 8/2004 |

OTHER PUBLICATIONS http://dow-answer.custhelp.com/cgi-bin/dow_answer.cfg/php/enduser/std_adp.php?p_faqid=3281&p_created=1112809668&p_topyiew=1.*

Patent Abstracts, JP 2001-305796A, Nov. 2, 2001 (corr. US 2001/0046636 A1).

Patent Abstracts, JP 2003-122051A, Apr. 25. 2003.

* cited by examiner

*Primary Examiner*—Mark F Huff
*Assistant Examiner*—Rachel L Zhang (Burney)
(74) *Attorney, Agent, or Firm*—Oblon, Spivak, McClelland, Maier & Neustadt, L.L.P.

(57) ABSTRACT

The present invention relates to a process for preparing a toner for electrophotography containing a resin binder and a colorant, including the step of preparing fine particles of the resin binder to have a volume-median particle size ($D_{50}$) of from 0.05 to 3 μm in an aqueous medium in the presence of a nonionic surfactant within a temperature range of from 10° C. below to 10° C. above a cloud point of the nonionic surfactant; and a toner for electrophotography obtained by the process as defined above, wherein the toner contains 60% by weight or more of a crystalline polyester and has a volume-median particle size ($D_{50}$) of from 1 to 7 μm. The toner obtained according to the process of the present invention can be suitably used, for example, in development of a latent image formed in electrophotography, electrostatic recording method, electrostatic printing method, or the like.

23 Claims, No Drawings

PROCESS FOR PREPARING TONER FOR ELECTROPHOTOGRAPHY

FIELD OF THE INVENTION

The present invention relates to a toner for electrophotography used for, for example, developing an electrostatic latent image formed in electrophotography, electrostatic recording method, electrostatic printing method, or the like, and a process for preparing the toner.

BACKGROUND OF THE INVENTION

In recent years toners have been desired to have smaller particle sizes from the viewpoint of achieving even higher image qualities. Processes for preparing toners include a melt-kneading and pulverization method, and a wet process such as an emulsification and aggregation method. When a toner containing a resin binder containing a crystalline polyester as a main component is prepared by the melt-kneading and pulverization method, it is difficult to control the pulverization, thereby making it impractical.

JP2003-122051 A and JP2001-305796 A each discloses an invention relating to the preparation of a toner by an emulsification and aggregation method, which is a wet process. However, in the process described in JP2003-122051 A, a resin is limited to one that is soluble in an organic solvent, and in the case of a resin having low solubility in an organic solvent, the yield of the toner is dramatically lowered. In addition, in the process described in JP2001-305796 A, a resin is limited to crystalline polyester containing specified raw material monomers.

SUMMARY OF THE INVENTION

The present invention relates to:

[1] a process for preparing a toner for electrophotography containing a resin binder and a colorant, including the step of preparing fine particles of the resin binder having a volume-median particle size ($D_{50}$) of from 0.05 to 3 μm in an aqueous medium in the presence of a nonionic surfactant within a temperature range of from 10° C. below to 10° C. above a cloud point of the nonionic surfactant; and

[2] a toner for electrophotography obtained by the process according to the above [1], wherein the toner contains 60% by weight or more of a crystalline polyester and has a volume-median particle size ($D_{50}$) of from 1 to 7 μm.

DETAILED DESCRIPTION OF THE INVENTION

The present invention relates to a process for preparing a toner for electrophotography having a small particle size in a high yield without being limited to the kind of a resin binder, and a toner for electrophotography obtained by the process.

According to the present invention, a toner having a small particle size can be obtained in a high yield without being limited to the kind of a resin binder. Further, according to the process of the present invention, since the toner can be prepared without an organic solvent, the process is also useful from the viewpoint of environmental friendliness and conservation of energy.

These and other advantages of the present invention will be apparent from the following description.

The toner for electrophotography obtained by the present invention contains at least a resin binder and a colorant.

The resin binder includes crystalline polyesters, amorphous polyesters, polyester-polyamides, vinyl resins such as styrene-acrylic resins, hybrid resins having a plural resin components, and the like. These resin binders can be used in admixture of two or more kinds. It is preferable that the resin binder contains at least a crystalline polyester from the viewpoint of low-temperature fixing ability. In this case, as a resin binder to be used together with a crystalline polyester, the hybrid resin in which an amorphous polyester component and a vinyl resin component are partially chemically bonded to each other and an amorphous polyester are preferable, among which the amorphous polyester is more preferable, from the viewpoint of compatibility of these resins with the crystalline polyester and fixing ability of the resulting toner.

The crystalline polyester is contained in the resin binder in an amount of preferably 60% by weight or more, more preferably 75% by weight or more, and even more preferably 80% by weight or more, from the viewpoint of low-temperature fixing ability. In addition, the crystalline polyester is contained in the toner in an amount of 60% by weight or more, more preferably 75% by weight or more, and even more preferably from 80 to 95% by weight.

The extent of the crystallinity of the polyester is expressed in index of crystallinity as defined by a ratio of the softening point to the highest temperature of endothermic peak determined by a differential scanning calorimeter, i.e., (softening point)/(highest temperature of endothermic peak). Generally, when the value for the index of crystallinity exceeds 1.5, the resin is amorphous; and when the value is less than 0.6, the crystallinity is low and much of the portions are amorphous. The extent of the crystallinity can be adjusted by the kinds of the raw material monomers and a ratio thereof, preparation conditions (for example, reaction temperature, reaction time, and cooling rate), and the like. The highest temperature of endothermic peak refers to the temperature of an endothermic peak on the highest temperature among the endothermic peaks observed. When a difference between the highest temperature of endothermic peak and the softening point is 20° C. or less, the peak temperature is defined as a melting point. When the difference between the highest temperature of endothermic peak and the softening point exceeds 20° C., the peak temperature is ascribed to a glass transition.

The crystalline polyester in the present invention refers to those having an index of crystallinity from 0.6 to 1.5. The crystalline polyesters has an index of crystallinity of preferably from 0.8 to 1.3, more preferably from 0.9 to 1.1, and even more preferably from 0.98 to 1.05, from the viewpoint of low-temperature fixing ability.

The crystalline polyester in the present invention can be prepared by a usual polycondensation reaction of raw material monomers. In other words, the crystalline polyester can be prepared by a dehydration polycondensation of carboxylic acid components and alcohol components, in the presence of a catalyst.

The carboxylic acid component includes aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; alicyclic dicarboxylic acids such as cyclohexanedicarboxylic acids; aromatic dicarboxylic acids such as phthalic acid, isophthalic acid, and terephthalic acid; tricarboxylic or higher polycarboxylic acids such as trimellitic acid and pyromellitic acid; acid anhydrides thereof, alkyl(1 to 3 carbon atoms) esters thereof; and the like. The above-mentioned acids, acid anhydrides and alkyl esters of the acids are collectively referred to herein as carboxylic acid compound.

It is preferable that the carboxylic acid component contains an aliphatic dicarboxylic acid compound having 2 to 0.6 carbon atoms, such as oxalic acid, malonic acid, maleic acid, fumaric acid, succinic acid, or adipic acid, from the viewpoint of enhancement of the crystallinity of the polyester. The ratio of the aliphatic dicarboxylic acid compound having 2 to 6 carbon atoms in the entire carboxylic acid component is preferably from 80 to 100% by mole, and more preferably from 90 to 100% by mole, from the viewpoint of enhancement of the crystallinity of the polyester. Even more preferably, fumaric acid and/or succinic acid is contained in an amount of from 80 to 100% by mole, and even more preferably from 90 to 100% by mole.

Also, it is preferable that the carboxylic acid component contains an aromatic dicarboxylic acid compound having an aromatic ring, such as terephthalic acid, isophthalic acid, phthalic acid and naphthalenedicarboxylic acids; or an alicyclic dicarboxylic acid compound, such as cyclohexanedicarboxylic acids, from the viewpoint of chargeability and durability of the toner. The content of these aromatic dicarboxylic acid compound and aliphatic dicarboxylic acid compound in the entire carboxylic acid component is preferably from 80 to 100% by mole, and more preferably from 90 to 100% by mole, from the viewpoint of chargeability and durability of the toner. It is preferable that terephthalic acid is contained in the entire carboxylic acid component preferably in an amount of from 80 to 100% by mole, and even more preferably from 90 to 100% by mole.

On the other hand, the alcohol component includes aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; aromatic diols such as an alkylene oxide adduct of bisphenol A, such as polyoxypropylene(2.2)-2,2-bis(4-hydroxyphenyl)propane and polyoxyethylene(2.2)-2,2-bis(4-hydroxyphenyl)propane; trihydric or higher polyhydric alcohols such as glycerol and pentaerythritol; and the like.

It is preferable that the alcohol component contains an aliphatic diol having 2 to 8 carbon atoms, from the viewpoint of enhancement of the crystallinity of the polyester. Among them, α,ω-linear alkanediols are more preferable, and 1,4-butanediol, 1,6-hexanediol, and 1,8-octanediol are even more preferable.

The aliphatic diol having 2 to 8 carbon atoms is contained in the entire alcohol component in an amount of preferably from 80 to 100% by mole, and more preferably from 90 to 100% by mole, from the viewpoint of enhancement of the crystallinity of the polyester. It is desired that 1,4-butanediol, 1,6-hexanediol, 1,8-octanediol or a mixture thereof is contained in the entire alcohol component preferably in an amount of from 80 to 100% by mole, and even more preferably from 90 to 100% by mole.

In other words, in order to accelerate the crystallinity of the polyester, it is preferable that the crystalline polyester is obtained by polycondensing an alcohol component containing an aliphatic diol having 2 to 8 carbon atoms in an amount of from 80 to 100% by mole, with a carboxylic acid component, which is a carboxylic acid compound, and even more preferably polycondensing an alcohol component containing an aliphatic diol having 2 to 8 carbon atoms in an amount of from 90 to 100% by mole, with a carboxylic acid component, which is a carboxylic acid compound.

In addition, in order to further accelerate the crystallinity of the polyester, it is preferable that the crystalline polyester is obtained by polycondensing an alcohol component containing an aliphatic diol having 2 to 8 carbon atoms in an amount of from 80 to 100% by mole, with a carboxylic acid component containing an aliphatic dicarboxylic acid compound having 2 to 6 carbon atoms in an amount of from 80 to 100% by mole, and even more preferably polycondensing an alcohol component containing an aliphatic diol having 2 to 8 carbon atoms in an amount of from 90 to 100% by mole, with a carboxylic acid component containing an aliphatic dicarboxylic acid compound having 2 to 6 carbon atoms in an amount of from 90 to 100% by mole.

On the other hand, it is preferable that the crystalline polyester is obtained by polycondensing an alcohol component containing an aliphatic diol having 2 to 8 carbon atoms in an amount of from 80 to 100% by mole, with a carboxylic acid component containing an aromatic dicarboxylic acid compound and/or an alicyclic dicarboxylic acid compound in an amount of from 80 to 100% by mole, and even more preferably polycondensing an alcohol component containing an aliphatic diol having 2 to 8 carbon atoms in an amount of from 90 to 100% by mole, with a carboxylic acid component containing an aromatic dicarboxylic acid compound and/or an alicyclic dicarboxylic acid compound in an amount of from 90 to 100% by mole, from the viewpoint of chargeability and durability of the toner.

The crystalline polyester has a melting point of preferably from 60° C. to 150° C., more preferably from 60° C. to 130° C., and even more preferably from 60° C. to 120° C., from the viewpoint of low-temperature fixing ability.

The crystalline polyester has a number-average molecular weight of preferably from 2000 to 100000, more preferably from 2000 to 20000, even more preferably from 2000 to 10000, and even more preferably from 2000 to 8000, from the viewpoint of emulsifiability, fixing ability and offset resistance.

On the other hand, it is preferable that the alcohol component of the amorphous polyester contains an alkylene oxide adduct of bisphenol A such as an alkylene(2 to 3 carbon atoms) oxide(average number of moles: 1 to 16) adduct of bisphenol A, such as polyoxypropylene(2.2)-2,2-bis(4-hydroxyphenyl)propane and polyoxyethylene(2.0)-2,2-bis(4-hydroxyphenyl)propane.

The alkylene oxide adduct of bisphenol A in the alcohol component is contained in an amount of preferably 5% by mole or more, more preferably 50% by mole or more, even more preferably 80% by mole or more, and even more preferably 100% by mole.

The amorphous polyester has a softening point of preferably from 95° C. to 160° C. and a glass transition temperature of preferably from 50° C. to 75° C.

The amorphous polyester has a number-average molecular weight of preferably from 1,000 to 100,000, more preferably from 1,000 to 50,000, and even more preferably from 1,000 to 12,000, from the viewpoint of durability and fixing ability.

It is preferable that the crystalline polyester and the amorphous polyester in the present invention have acidic groups at the terminal of the molecule. The acidic group includes a carboxyl group, a sulfonate group, a phosphonate group, a sulfinate group and the like. The carboxyl group is preferable from the viewpoint of satisfying both emulsifiability of the resin and environmental durability of the toner prepared therefrom. The amount of the acidic groups at the terminal of the molecule of the crystalline polyester and the amorphous polyester is one of the important factors for determining the stability of the emulsion particles and the particle size distribution and particle size of the toner. In order to stabilize the emulsion particles and obtain a toner having a small particle size with a sharp particle size distribution, the amount of the acidic groups at the terminal of the molecule is preferably from 0.015 to 0.9 mmol, more preferably from 0.08 to 0.85 mmol, even more preferably from 0.15 to 0.8 mmol, and even more preferably from 0.25 to 0.75 mmol, per 1 g of the crystalline polyester or the amorphous polyester.

The crystalline polyester and the amorphous polyester have an acid value of, for example, preferably from 1 to 50 mg KOH/g, more preferably from 5 to 48 mg KOH/g, even more preferably from 10 to 45 mg KOH/g, and even more preferably from 15 to 40 mg KOH/g, per 1 g of the crystalline polyester or the amorphous polyester, from the viewpoint of stabilizing the emulsion particles and obtaining a toner having a small particle size with a sharp particle size distribution.

In addition, a carboxyl group can be introduced into the main chain of the polyester molecule by using a polycarboxylic acid such as trimellitic acid as a carboxylic acid component or a polyhydric alcohol such as pentaerythritol as an alcohol component as occasion demands. The amount of the acidic groups in the main chain of the polyester molecule is preferably 5% by mole or less, more preferably 3% by mole or less, and even more preferably 1% by mole or less, based on the number of moles of the entire carboxylic acid component constituting the polyester, from the viewpoint of inhibition of crystallization.

In addition, the molar ratio as expressed by acidic groups in the main chain of the molecule to the acidic groups at the terminal of the molecule in the crystalline polyester and the amorphous polyester is preferably 30% by mole or less, more preferably 20% by mole or less, even more preferably 10% by mole or less, even more preferably 5% by mole or less, and even more preferably 2% by mole or less, from the same viewpoint.

The amount of the acidic groups in the main chain of the crystalline polyester molecule and the amorphous polyester molecule and at the terminal of the molecules thereof can be calculated from the structures and the charging ratio of the raw material acid and the raw material alcohol for the polyester, the number-average molecular weight of the polyester, and the determination of the acid value. Also, the amount can be obtained by using an analytic means such as nuclear magnetic resonance spectroscopy (NMR) or X-ray photoelectron spectroscopy (XPS, ESCA, or the like) in combination with the determination of the acid value.

The colorant is not particularly limited, and includes known colorants, which can be properly selected according to its purposes. Specifically, the colorant includes various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue, Phthalocyanine Green, and Malachite Green Oxalate; and various dyes such as Acridine dyes, Xanthene dyes, azo dyes, benzoquinone dyes, Azine dyes, anthraquinone dyes, indigo dyes, thioindigo dyes, Phthalocyanine dyes, Aniline Black dyes, polymethine dyes, triphenylmethane dyes, diphenylmethane dyes, thiazine dyes, thiazole dyes, and xanthene dyes, and these pigments and dyes can be used alone or in admixture of two or more kinds.

Further, an additive such as a releasing agent, a charge control agent, an electric conductivity modifier, an extender, a reinforcing filler such as a fibrous substance, an antioxidant, or an anti-aging agent may be appropriately added to the toner obtained by the present invention.

It is preferable that the toner in the present invention contains a releasing agent. By the addition of the releasing agent, the releasing property of the toner is improved in the fixing step, so that the releasing oil to be applied to a fixing roller in a contact heat-fixing method can be reduced or may not be used.

The releasing agent includes low-molecular weight polyolefins such as polyethylene, polypropylene and polybutene; silicones; fatty acid amides such as oleic amide, erucic amide, recinoleic acid amide, and stearic acid amide; plant-derived waxes such as carnauba wax, rice wax, candelilla wax, haze wax, and jojoba oil; animal-derived waxes such as beeswax; mineral and petroleum waxes such as montan wax, ozokerite, sericite, paraffin wax, microcrystalline wax, and Fischer-Tropsch wax; and the like. These releasing agents can be used alone or in admixture of two or more kinds.

The releasing agent has a melting point of preferably from 50° C. to 120° C., and more preferably equal to or lower than the melting point of the resin binder, in consideration of the influence on blocking resistance and the low-temperature fixing ability of the resin binder. The amount of the releasing agent formulated is preferably from 1 to 20 parts by weight, more preferably from 2 to 15 parts by weight, even more preferably from 2 to 10 parts by weight, based on 100 parts by weight of the resin binder, in consideration of the effects on the low-temperature offset, and the influence on the chargeability, the carrier spent of the toner resin, and the like.

The charge control agent includes a chromium-based azo dye, an iron-based azo dye, an aluminum-based azo dye, a metal complex of salicylic acid, and the like.

The process for preparing the toner of the present invention has a feature in the step of preparing fine particles of a resin binder in an aqueous medium within a specified temperature range in the presence of a nonionic surfactant. Thereafter, the toner for electrophotography can be obtained, for example, by allowing the fine particles of a resin binder to aggregate, to give aggregate particles (aggregating step), thereafter unifying the resulting aggregate particles (unifying step), separating the resulting unified particles, washing and drying the unified particles.

The fine particles of a resin binder can be prepared by mixing a resin binder and a nonionic surfactant, and heating the mixture while stirring, thereby lowering the viscosity of the mixture. The present inventors have found that the viscosity of the mixture is lowered due to the fact that the nonionic surfactant is compatible with the resin binder so that a softening point of the resin is surprisingly seemingly lowered. By utilizing this phenomenon, if the softening point of the resin binder compatible with the nonionic surfactant can be seemingly lowered to a temperature equal to or lower than the boiling point of water, even in a resin binder having a melting point or a glass transition temperature of 100° C. or higher in the case of the resin alone, a dispersion in which the resin binder is dispersed in water can be obtained by adding water dropwise thereto under normal pressure. Since the dispersion can be prepared by using at least water and a nonionic surfactant, there are some advantages that a resin insoluble to an organic solvent is also applicable, and that collection of an organic solvent or the equipment loads for maintaining operable environments used in JP2003-122051 A, JP2001-305796 A, or the like would not be necessitated, so that a resin dispersion can be prepared economically advantageously. Therefore, the aqueous medium used in the present invention may contain a solvent such as an organic solvent, and the aqueous medium contains preferably 95% by weight of water or more, and more preferably 99% by weight of water or more. In the present invention, fine particles of a resin binder can be prepared even when water alone is used without substantially using an organic solvent.

In view of the above, as a result of further studies on the conditions for making a nonionic surfactant compatible with a resin binder, the change in the property of the nonionic surfactant in a cloud point has been found to be an important factor.

In other words, generally, as the temperature of an aqueous solution of a nonionic surfactant is raised, a transparent aqueous solution starts to be turbid at a certain temperature. This temperature is referred to as "cloud point." Although not wanting to be limited by theory, this phenomenon is caused when a surfactant is dissolved in water and its hydrogen bond between the hydrophilic group in a molecule and water is cleaved. Therefore, the nonionic surfactant becomes oil-soluble and loses its ability of interfacial activity at a temperature of the cloud point or higher. Accordingly, the present inventors have remarked that this property of the nonionic surfactant can be utilized as a means of controlling particle sizes of fine resin particles. In other words, the nonionic surfactant is allowed to be compatible with the resin binder by controlling the dispersion or emulsification system containing the nonionic surfactant in an amount far greater than that conventionally used to usually aid the emulsification of fine resin particles at a temperature near the cloud point, whereby the particle sizes of the fine resin particles can be surprisingly easily changed.

When the fine particles of the resin binder is prepared, it is important to keep the temperature in the system within the temperature range of 10° C. below to 10° C. above, preferably 8° C. below to 8° C. above, and more preferably 5° C. below to 5° C. above, the cloud point of the nonionic surfactant. The temperature is equal to or lower than a temperature calculated from the cloud point of the nonionic surfactant plus 10° C., from the viewpoint of dispersibility of the nonionic surfactant; and the temperature is equal to or higher than a temperature calculated from the cloud point minus 10° C., from the viewpoint of dispersion efficiency.

The nonionic surfactant includes, for example, polyoxyethylene alkylaryl ethers or polyoxyethylene alkyl ethers such as polyoxyethylene nonylphenyl ether, polyoxyethylene oleyl ether, and polyoxyethylene lauryl ether; polyoxyethylene sorbitan esters such as polyoxyethylene sorbitan monolaurate and polyoxyethylene sorbitan monostearate; polyoxyethylene fatty esters such as polyethylene glycol monolaurate, polyethylene glycol monostearate, and polyethylene glycol monooleate; and oxyethylene/oxypropylene block copolymers. In addition, the nonionic surfactant may be used together with an anionic surfactant or a cationic surfactant, as long as the effects of the present invention are not impaired.

The amount of the nonionic surfactant is preferably 5 parts by weight or more, more preferably 8 parts by weight or more, even more preferably 10 parts by weight or more, and even more preferably 20 parts by weight or more, based on 100 parts by weight of the resin binder, from the viewpoint of lowering the melting point of the resin binder. On the other hand, the amount of the nonionic surfactant is preferably 80 parts by weight or less, more preferably 70 parts by weight or less, and even more preferably 60 parts by weight or less, based on 100 parts by weight of the resin binder, from the viewpoint of controlling the nonionic surfactant remaining in the toner. From the viewpoint of satisfying both aspects as described above, the amount of the nonionic surfactant is preferably from 5 to 80 parts by weight, more preferably from 8 to 80 parts by weight, even more preferably from 10 to 70 parts by weight, and even more preferably from 20 to 60 parts by weight.

When the fine particles of the resin binder are prepared in water under normal pressure, the nonionic surfactant has a cloud point of preferably from 70° C. to 105° C., and more preferably from 80° C. to 105° C.

In the steps of aggregating and unifying the particles, it is desired that mild aggregation and rapid unifying are carried out, from the viewpoint of controlling particle sizes of toner. From this viewpoint, it is preferable that the aggregating step is carried out at a temperature near the cloud point of the nonionic surfactant, and that the unifying step is carried out at a temperature of the cloud point or higher. This temperature adjustment means that particles are aggregated at a temperature at which the surfactant acts effectively and that the aggregate particles are unified at a temperature at which the surfactant loses its effects.

In addition, in the aggregating and unifying steps, it is preferable that both the steps are carried out at a temperature near the softening point of the resin binder because the resin binder needs to be fused. Therefore, it is preferable that the cloud point (Tc) of the nonionic surfactant and the softening point (Ts) of the resin binder satisfy the relationship of:

$$Ts-30<Tc<Ts,$$

and more preferably satisfying the relationship of:

$$Ts-30<Tc<Ts-10,$$

from the viewpoint of controlling shapes and particle sizes of the toner during the aggregating and unifying steps.

In the selection of a nonionic surfactant, it is important that one having an excellent compatibility with resins is selected. In order to obtain a stable dispersion of a resin binder, it is preferable that the nonionic surfactant has an HLB (hydrophile-lipophile balance) value of preferably from 12 to 18, and it is more preferable that two or more kinds of nonionic surfactants having different HLB values are used depending upon the kind of resin binder. For example, when a resin having a high hydrophilicity is used, at least one kind of nonionic surfactant having an HLB value of from 12 to 18 may be used. When a resin having a high hydrophobicity is used, it is preferable that two kinds of nonionic surfactants having different HLB values, namely a nonionic surfactant having a low HLB value, for example, an HLB value of from 7 to 10 or so, and a nonionic surfactant having a high HLB value, for example, an HLB value of from 14 to 20, are used together so as to give a weighed average of each HLB value to from 12 to 18. In this case, it is assumed that mainly nonionic surfactants having an HLB value of from 7 to 10 or so are allowed to be compatible with resins, and the one having a high HLB value stabilizes the dispersion of the resins in water.

In the step of preparing fine particles of a resin binder, it is preferable that, for example, water, preferably deionized water or distilled water, is added dropwise to a homogeneous mixture of resin binders with nonionic surfactants in the system after stirring. It is preferable that careful precaution is taken so that the resin binder which is made compatible with the nonionic surfactant is not separated from water in this step.

The amount of water mixed is preferably 100 parts by weight or more, based on 100 parts by weight of the resin binder, from the viewpoint of obtaining homogeneously aggregate particles in the subsequent steps.

The particle size of the dispersed particles of the resin binder in the dispersion can be controlled by the amount of the nonionic surfactant, the agitation force, and the rate of dropping water.

When the resin binder has an acidic group such as a carboxyl group or a sulfonate group, water may be added after or while all or part of the resin binder is neutralized. When the resin binder having an acidic group is used, besides the factor of the nonionic surfactant, the factor of self-emulsifiability of the resin can be a controlling factor for the particle size of the dispersed particles of the resin.

A dispersant can be used as occasion demands for the purposes of lowering the melt index and the melting point of the resin binder, and improving the dispersibility of the formed dispersion. The dispersant includes, for example, water-soluble polymers such as polyvinyl alcohol, methyl cellulose, ethyl cellulose, hydroxyethyl cellulose, carboxymethyl cellulose, sodium polyacrylate, and sodium polymethacrylate; anionic surfactants such as sodium dodecylbenzenesulfonate, sodium octadecyl sulfate, sodium oleate, sodium laurate, and potassium stearate; cationic surfactants such as laurylamine acetate, stearylamine acetate, and lauryl trimethylammonium chloride; amphoteric surfactants such as lauryl dimethylamine oxide; and inorganic salts such as tricalcium phosphate, aluminum hydroxide, calcium sulfate, calcium carbonate, and barium carbonate. The amount of the dispersant formulated is preferably 20 parts by weight or less, more preferably 15 parts by weight or less, and even more preferably 10 parts by weight or less, based on 100 parts by weight of the resin binder, from the viewpoint of emulsion stability and detergency.

The solid content of the system for preparing the dispersion of the resin binder is preferably from 7 to 50% by weight, more preferably from 7 to 40% by weight, and even more preferably from 10 to 30% by weight, from the viewpoint of stability of the dispersion and handling property of the dispersion in the aggregating step. The solid contains non-volatile components such as a resin and a nonionic surfactant.

The volume-median particle size ($D_{50}$) of the finely prepared resin binder is selected according to the particle size of the toner to be obtained from the resin is from 0.05 to 3 μm. In order to obtain a high-image quality toner, the volume-median particle size ($D_{50}$) is preferably from 0.05 to 0.5 μm, more preferably from 0.05 to 0.3 μm, and even more preferably from 0.05 to 0.2 μm.

A colorant, and an additive such as a releasing agent and a charge control agent can be added at any of the steps. For example, before the finely prepared resin binder is aggregated, a dispersion of the resin binder is mixed with a dispersion of a colorant or the like, whereby aggregate particles containing at least the resin binder and the colorant as the constituents can be obtained.

It is preferable that the dispersion containing the finely prepared resin binder is cooled to room temperature before proceeding to the aggregating step, from the viewpoint of preparing toners having small particle sizes in a high yield.

A colorant and other additives as occasion demands in the form of, for example, a dispersion are mixed with the dispersion of the above-mentioned resin binder, and the dispersed particles are allowed to grow to form aggregate particles containing at least the resin binder and the colorant as constituents.

The solid content of the system in the aggregating step can be adjusted by adding water to the dispersion of the resin binder as occasion demands. The solid content is preferably from 5 to 50% by weight, more preferably from 5 to 30% by weight, and even more preferably from 5 to 20% by weight, in order to give homogeneous aggregation.

In addition, the pH of the system in the aggregating step is preferably from 2 to 10, more preferably from 4 to 8, and even more preferably from 4.5 to 7.5, from the viewpoint of satisfying both dispersion stability of the liquid mixture and aggregation property of the fine particles such as the resin binder and the colorant.

The temperature of the system in the aggregating step is preferably equal to or higher than a temperature calculated from the softening point of the resin binder−(minus) 50° C. and equal to or lower than a temperature calculated from the softening point−(minus) 10° C., more preferably equal to or higher than a temperature calculated from the softening point of the resin binder−30° C. and equal to or lower than a temperature calculated from the softening point−10° C., from the same viewpoint.

In the aggregating step, in order to effectively carry out the aggregation, an aggregating agent can be added. As the organic aggregating agent, a cationic surfactant in the form of a quaternary salt, polyethyleneimine, or the like may be used, and as the inorganic aggregating agent, an inorganic metal salt, a divalent or higher polyvalent metal complex or the like may be used. The inorganic metal salt includes, for example, metal salts such as sodium sulfate, sodium chloride, calcium chloride, calcium nitrate, barium chloride, magnesium chloride, zinc chloride, aluminum chloride, and aluminum sulfate; and inorganic metal salt polymers such as poly(aluminum chloride), poly(aluminum hydroxide), and poly(calcium sulfide). Among them, trivalent aluminum salt and its polymers are preferable because these aggregating agents have the high aggregation ability with a small amount and can be conveniently prepared. In addition, the metal complex and the cationic surfactant in the form of a quaternary salt are more preferable from the viewpoint of controlling the charging properties.

The amount of the aggregating agent is preferably 30 parts by weight or less, more preferably 20 parts by weight or less, and even more preferably 10 parts by weight or less, based on 100 parts by weight of the resin binder, from the viewpoint of the environmental resistance of the toner.

It is preferable that the aggregating agent is added in the form of an aqueous solution, and that the mixture is sufficiently stirred during the addition of the aggregating agent and after the termination of the addition.

The aggregate particles, containing at least the resin binder and the colorant as the constituents, which are obtained in the above-mentioned aggregating step are heated to unify.

The heating temperature during the unifying of the aggregate particles is preferably equal to or higher than a temperature calculated from the softening point of the resin binder−(minus) 10° C. and equal to or lower than a temperature calculated from the softening point of the resin binder+(plus) 10° C., more preferably equal to or higher than the softening point of the resin binder−5° C. and equal to or lower than a temperature calculated from the softening point+10° C., and even more preferably equal to or higher than the softening point of the resin binder and equal to or lower than a temperature calculated from the softening point of the resin binder+10° C., from the viewpoint of controlling particle sizes, particle size distribution, and shapes of the desired toner, and fusibility of the aggregate particles. In addition, it is preferable that the stirring rate is a rate at which the aggregate particles are not precipitated.

In the aggregating and unifying steps, it is preferable that the temperature of the finely prepared resin binder is raised while keeping the temperature at least in two stages for a given period of time, from the viewpoint of narrowing the particle size distribution of the toner for obtaining high image quality. Specifically, it is preferable that the finely prepared resin binder is kept in the aqueous medium at least at $T_1$° C. and $T_2$° C. for 30 to 180 minutes each, satisfying the following formulas (I) and (II):

$$Ts-100<T_1<Ts-5 \quad (I)$$

$$T_1<T_2\leqq T_1+20 \quad (II)$$

wherein Ts is a softening point (° C.) of the resin binder. Here, each of $T_1$° C. and $T_2$° C. is an average temperature within the time kept, and it is desired that both $T_1$° C. and $T_2$° C. are controlled to a temperature within preferably ±2° C., more preferably ±1° C., even more preferably ±0.5° C., of the average temperature.

In the above-mentioned two-stage temperature raise, the aggregate particles having a certain particle size distribution are mainly formed at a temperature $T_1$° C., and the formed aggregate particles are unified at a temperature $T_2$° C. Although not wanting to be limited by theory, particles having small particle sizes and a relatively high surface energy grow faster than those having large particle sizes and a relatively low surface energy, whereby a two-stage temperature raise makes the particle sizes even and the particle size distribution of the obtained particles narrow.

In the formula (I), it is preferable that the temperature $T_1$ is higher than a temperature calculated as (Ts−100)° C., from the viewpoint of controlling the viscosity of the resin binder and promoting further homogeneous aggregation, and lower than a temperature calculated as (Ts−5)° C., from the viewpoint of preventing rapid aggregation and excessive growing of the particles. From these viewpoints, the formula (I) is preferably $$Ts-100<T_1<Ts-20,$$

and more preferably $$Ts-90<T_1<Ts-20.$$

Although the volume-median particle size ($D_{50}$) of the aggregate particles formed at the termination of keeping the finely prepared resin binder at a temperature $T_1$° C. depends upon the particle size of the toner to be finally prepared, the aggregate particles have a volume-median particle size ($D_{50}$) of preferably from 1 to 6 μm, more preferably from 1.5 to 5.5 μm, and even more preferably from 2 to 5 μm, from the viewpoint of narrowing the particle size distribution of the unified particles obtained at the subsequent temperature of $T_2$° C. or narrowing the particle size distribution of the toner.

In addition, from the viewpoint of mildly forming unified particles and narrowing the particle size distribution of the toner, the formula (II) is preferably $$T_1<T_2\leqq T_1+15,$$

and more preferably $$T_1+2\leqq T_2\leqq T+15.$$

The time to keep the temperature at each of $T_1$° C. and $T_2$° C. is preferably for 30 to 180 minutes, and more preferably for 30 to 90 minutes. The aggregated particles may be further kept at another temperature between $T_1$ and $T_2$ during the course of raising the temperature from $T_1$ to $T_2$.

When the temperature of the finely prepared resin binder is raised in an aqueous medium, the finely prepared resin starts to gradually aggregate around 30° C. Therefore, the time for which the temperature of the resin binder is kept within a range of 30° C. to $T_2$° C. is preferably 1 hour or more, and more preferably from 1 to 8 hours, from the viewpoint of sufficiently unifying the aggregate particles to form unified particles and controlling crush of the toner particles in a printer when the toner is loaded to a printer or the like. From the viewpoint of preventing the additives (a colorant, a releasing agent, or the like) in particles from collecting together in the process of unifying, the time is preferably 6 hours or less. From these viewpoints, the time for which the temperature of the resin binder is kept within a range of 30° C. to $T_2$° C. is preferably from 1 to 8 hours, more preferably from 1 to 6 hours, even more preferably from 1.5 to 5 hours, and even more preferably from 1.5 to 4.5 hours. The shape of the toner can also be controlled by adjusting this time period. For example, when the time is shortened, the toner is likely to have a potato-like shape having rugged surface, and when the time is lengthened, the toner is likely to have a nearly spherical shape.

The resulting unified toner is subjected through the steps such as liquid-solid separation step such as filtration, washing step, and drying step, whereby a toner can be obtained.

In the washing step, it is preferable that an acid is used for removing metal ions on the toner surface, in order to secure satisfactory chargeability and reliability as a toner. Also, it is preferable that the added nonionic surfactant is removed by washing, and the washing is carried out with an aqueous medium at a temperature equal to or lower than the cloud point of the nonionic surfactant. The washing is carried out preferably plural times.

In addition, in the drying step, any methods such as vibration-type fluidizing drying method, spray-drying method, freeze-drying method, or flash jet method can be employed. It is desired that the water content after drying the toner particles is adjusted to preferably 1.5% by weight or less, and more preferably 1.0% by weight or less, from the viewpoint of chargeability of the toner.

According to the present invention, a spherical toner having a small particle size and a narrow particle size distribution suitable for high precision and high image quality can be obtained.

The toner has a volume-average particle size ($D_{50}$) is preferably from 1 to 7 μm, more preferably from 2 to 7 μm, and even more preferably from 3 to 6 μm, from the viewpoint of high image quality and productivity.

In addition, the toner has a softening point of preferably from 60° C. to 140° C., more preferably from 60° C. to 130° C., and even more preferably from 60° C. to 120° C., from the viewpoint of low-temperature fixing ability. In addition, the toner has a highest temperature of endothermic peak determined by a differential scanning calorimeter of preferably from 60° C. to 140° C., more preferably from 60° C. to 130° C., and even more preferably from 60° C. to 120° C., from the same viewpoint.

In the toner obtained by the present invention, an external additive such as a fluidizing agent can be added to the surface of the toner particles. As the external additive, known fine particles, such as fine silica particles of which surface is subjected to a hydrophobic treatment, fine titanium oxide particles, fine alumina particles, fine cerium oxide particles, and carbon black, or fine polymer particles such as polycarbonate, poly(methyl methacrylate) or silicon resin can be used.

The external additive has a number-average particle size of preferably from 4 to 200 nm, and more preferably from 8 to 30 nm. The number-average particle size of the external additive can be obtained by using a scanning electron microscope or a transmission electron microscope.

The amount of the external additive formulated is preferably from 1 to 5 parts by weight, and more preferably from 1.5 to 3.5 parts by weight, based on 100 parts by weight of the toner before the treatment with the external additive. Here, when a hydrophobic silica is used as an external additive, the desired effects as described above can be obtained by using the hydrophobic silica in an amount of from 1 to 3 parts by weight, based on 100 parts by weight of the toner before the treatment with the external additive.

The toner for electrophotography obtained by the present invention can be used as a nonmagnetic monocomponent developer, or as a two-component developer obtained by mixing the toner with a carrier.

EXAMPLES

The following examples further describe and demonstrate embodiments of the present invention. The examples are given solely for the purposes of illustration and are not to be construed as limitations of the present invention.

1. Acid Value of Resins

Determined according to JIS K0070.

2. Softening Point, Highest Temperature of Endothermic Peak, Melting Point, and Glass Transition Point of Resins (1) Softening Point The softening point refers to a temperature at which a half the amount of the sample flows out when plotting a downward movement of a plunger against temperature, as measured by using a flow tester (CAPILLARY RHEOMETER "CFT-500D," commercially available from Shimadzu Corporation), in which a 1 g sample is extruded through a nozzle having a die pore size of 1 mm and a length of 1 mm while heating the sample so as to raise the temperature at a rate of 6° C./min and applying a load of 1.96 MPa thereto with the plunger.

(2) Highest Temperature of Endothermic Peak and Melting Point

The highest temperature of endothermic peak is determined using a differential scanning calorimeter ("DSC 210," commercially available from Seiko Instruments, Inc.), by raising its temperature to 200° C., cooling the hot sample from this temperature to 0° C. at a cooling rate of 10° C./min, and thereafter heating the sample so as to raise the temperature at a rate of 10° C./min. Among the endothermic peaks observed, the temperature of an endothermic peak on the highest temperature side is defined as a highest temperature of endothermic peak. When a difference between the highest temperature of endothermic peak and the softening point is within 20° C., the peak temperature is defined as a melting point. When the highest temperature of endothermic peak is equal to or lower than the temperature calculated from the softening minus 20° C., the peak is ascribed to glass transition.

(3) Glass Transition Temperature

The glass transition temperature is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a rate of 10° C./min. When a peak is observed at a temperature equal to or lower than the temperature calculated from the softening point minus 20° C., the peak temperature thereof is read off as a glass transition temperature, and when a shift of the curve is observed without any observations of peaks at a temperature equal to or lower than the temperature calculated from the softening point minus 20° C., the temperature of an intersection of the tangential line having the maximum inclination of the curve in the portion of the curve shift and the extended baseline of the high-temperature side of the curve shift is read off as a glass transition temperature. The glass transition temperature is a property inherently owned by the amorphous portion in the resin, which may be generally observed in an amorphous polyester, or may be also observed in an amorphous portion of a crystalline polyester in some cases.

3. Index of Crystallinity for Resins

The index of crystallinity is calculated as a degree of the crystallinity from the softening point and the highest temperature of endothermic peak determined in accordance with the methods mentioned above using the following formula:

$$\text{Index of Crystallinity} = \frac{\text{Softening Point}}{\text{Highest Temperature of Endothermic Peak}}$$

4. Number-Average Molecular Weight of Resins

The number-average molecular weight is obtained from the molecular weight distribution determined by the gel permeation chromatography according to the following method.

(1) Preparation of Sample Solution

A crystalline polyester is dissolved in chloroform and an amorphous polyester is dissolved in tetrahydrofuran, so as to each have a concentration of 0.5 g/100 ml. Each of the resulting solution is then filtered with a fluororesin filter ("FP-200," commercially available from Sumitomo Electric Industries, Ltd.) having a pore size of 2 μm to remove insoluble components, to give a sample solution.

(2) Determination of Molecular Weight Distribution

As an eluant, chloroform when determining for a crystalline polyester, or tetrahydrofuran for an amorphous polyester is allowed to flow at a rate of 1 ml/min, and the column is stabilized in a thermostat at 40° C. One-hundred microliters of the sample solution is injected to the column to determine the molecular weight distribution. The molecular weight of the sample is calculated on the basis of a calibration curve previously prepared. The calibration curve of the molecular weight is one prepared by using several kinds of monodisperse polystyrenes as standard samples.

Analyzer: CO-8010 (commercially available from Tosoh Corporation)

Column: GMHLX+G3000HXL (commercially available from Tosoh Corporation)

5. Particle Size of Dispersed Particles and Particle Size of Aggregated and Unified Particles of Resins (1) Measuring Apparatus: Laser diffraction particle size analyzer ("LA-920," commercially available from HORIBA, Ltd.)

(2) Measurement Conditions: A cell for determination is charged with distilled water and a volume-median particle size ($D_{50}$) is obtained at a concentration of the dispersion so that its absorbance is within a proper range.

6. Particle Size of Toners (1) Preparation of Dispersion: 10 mg of a sample to be measured is added to 5 ml of a dispersion medium (a 5% by weight aqueous solution of "EMULGEN 109P" (commercially available from Kao Corporation, polyoxyethylene lauryl ether, HLB value: 13.6)), and dispersed with an ultrasonic disperser for one minute. Thereafter, 25 ml of electrolytic solution ("Isotone II" (commercially available from Beckman Coulter)) is added thereto, and the mixture is further dispersed with the ultrasonic disperser for one minute, to give a dispersion.

(2) Measuring Apparatus: Coulter Multisizer II (commercially available from Beckman Coulter)

Aperture Diameter: 100 μm

Range of Particle Sizes to Be Determined: 2 to 60 μm

Analyzing Software: Coulter Multisizer AccuComp Ver. 1.19 (commercially available from Beckman Coulter)

(3) Measurement Conditions: One-hundred milliliters of an electrolyte and a dispersion are added to a beaker, and the particle sizes of 30000 particles are determined under the conditions for concentration satisfying that the determination for 30000 particles are completed in 20 seconds, to determine its volume-median particle sizes ($D_{50}$).

Preparation Example 1 of Crystalline Polyester

A 5 liter-four-neck flask equipped with a nitrogen inlet tube, a dehydration tube, a stirrer, and a thermocouple was charged with 1652 g of 1,6-hexanediol, 364 g of neopentyl glychol, 2905 g of terephthalic acid, and 10 g of dibutyltin oxide, and the ingredients were reacted at 200° C. until granules of terephthalic acid were not observed. Thereafter, the ingredients were further reacted at 8.3 kPa for 1 hour, to give a resin A. The resin A had a softening point of 115.6° C., a highest temperature of endothermic peak (melting point) of 118.6° C., an index of crystallinity of 0.98, an acid value of 35 mg KOH/g, and a number-average molecular weight of 4450.

Preparation Example 1 of Amorphous Polyester

A four-neck flask equipped with a nitrogen inlet tube, a dehydration tube, a stirrer, and a thermocouple was charged with 16800 g of polyoxypropylene(2.2)-2,2-bis(4-hydroxyphenyl)propane, 5800 g of fumaric acid, and 15 g of dibutyltin oxide, and the ingredients were reacted at 230° C. under a nitrogen atmosphere while stirring, until the softening point determined according to ASTM D36-86 reached 100° C., to give a resin B. The resin B had a softening point of 98° C., a highest temperature of endothermic peak of 63° C., an index of crystallinity of 1.6, a glass transition temperature of 56° C., an acid value of 22.4 mg KOH/g, and a number-average molecular weight of 2930.

Preparation Example 2 of Amorphous Polyester

A four-neck flask equipped with a nitrogen inlet tube, a dehydration tube, a stirrer, and a thermocouple was charged with 33750 g of polyoxypropylene(2.2)-2,2-bis(4-hydroxyphenyl)propane, 325 g of polyoxyethylene(2.0)-2,2-bis(4-hydroxyphenyl)propane, 6960 g of fumaric acid, 6723 g of terephthalic acid, and 15 g of dibutyltin oxide, and the ingredients were reacted at 230° C. under a nitrogen atmosphere while stirring, until the softening point determined according to ASTM D36-86 reached 110° C., to give a resin C. The resin C had a softening point of 111° C., a highest temperature of endothermic peak of 70° C., an index of crystallinity of 1.59, an acid value of 24.0 mg KOH/g, and a number-average molecular weight of 4090.

Preparation Example 3 of Amorphous Polyester

A four-neck flask equipped with a nitrogen inlet tube, a dehydration tube, a stirrer, and a thermocouple was charged with 17500 g of polyoxypropylene(2.2)-2,2-bis(4-hydroxyphenyl)propane, 16250 g of polyoxyethylene(2.0)-2,2-bis(4-hydroxyphenyl)propane, 11450 g of terephthalic acid, 4800 g of trimellitic anhydride, 1600 g of dodecenylsuccinic anhydride, and 15 g of dibutyltin oxide, and the ingredients were reacted at 230° C. under a nitrogen atmosphere while stirring, until the softening point determined according to ASTM D36-86 reached 125° C., to give a resin D. The resin D had a softening point of 125° C., a highest temperature of endothermic peak of 69° C., an index of crystallinity of 1.81, an acid value of 21.0 mg KOH/g, and a number-average molecular weight of 3390.

Example 1

Two-hundred grams of the resin A and 100 g of a nonionic surfactant (polyoxyethylene lauryl ether (EO=9 mol added), cloud point: 98° C., HLB value: 15.3) were melted at 170° C. in a 5 liter-stainless steel pot, while stirring with a paddle-shaped stirrer at a rate of 200 r/min. The ingredients were stabilized at 95° C., which is a temperature 3° C. lower than the cloud point of the nonionic surfactant, and 68.5 g of an aqueous sodium hydroxide (concentration: 5% by weight) was added dropwise thereto as a neutralizing agent, while stirring with the paddle-shaped stirrer at a rate of 200 r/min. Subsequently, deionized water was added dropwise to the mixture while stirring with the paddle-shaped stirrer at a rate of 300 r/min, totaling to an amount of 1631.5 g. During the addition, the temperature of the system was kept at 95° C., and a resin dispersion containing finely prepared resin A was obtained through a wire mesh having a 200 mesh screen (opening: 105 μm). The resin particles in the resulting resin dispersion had a volume-median particle size of 0.47 μm and a solid content of 12.0% by weight. No resin components remained on the wire mesh.

Four-hundred grams of the resulting resin dispersion and 40 g of a cyan pigment-containing aqueous dispersion (concentration: 5% by weight) were mixed in a 1 liter vessel at room temperature (25° C.). Next, an aqueous solution containing a 1 g portion of calcium chloride as an aggregating agent was added to the mixture, and the pH was adjusted to 7 with an aqueous sodium carbonate (concentration: 10% by weight). Thereafter, the mixture was stirred with a homo mixer at a rotational speed of 5000 r/min at room temperature for 1 hour. The resulting mixed dispersion was transferred to a 1 liter autoclave, heated to 105° C. ($T_1$), and stirred at 500 r/min for 6 hours, to form aggregate particles. The aggregate particles formed had a volume-median particle size ($D_{50}$) of 5.1 μm.

Thereafter, the mixed dispersion was heated to 125° C. ($T_2$), and stirred for an additional 1 hour to unify aggregate particles. Subsequently, the mixed dispersion was subjected to a suction filtration step, a washing step, and a drying step, to give a fine colored resin particle powder. The fine colored resin particle powder had a volume-median particle size ($D_{50}$) of 6.7 μm and a water content of 0.3% by weight. The time to raise the temperature from 30° C. to $T_2$° C. was 7 hours and 40 minutes.

A hydrophobic silica ("TS530," commercially available from Wacker Chemicals, number-average particle size: 8 nm) was externally added in an amount of 1.0 part by weight, based on 100 parts by weight of the fine colored resin particle powder with a Henschel mixer, to give a cyan toner. The resulting cyan toner had a volume-median particle size ($D_{50}$) of 6.7 μm and a softening point of 110° C.

A developer prepared by adding silicone-coated ferrite carrier (commercially available from Kanto Denka Kogyo Co., Ltd.) having an average particle size of 60 μm to the resulting toner was loaded to a commercially available copying machine. When printing was carried out, an excellent image was obtained.

Example 2

One-thousand grams of the resin B and 200 g of a nonionic surfactant (polyoxyethylene stearyl ether (EO=20 mol added), cloud point: 74° C., HLB value: 13.9) were melted at 170° C. in a 10 liter-stainless steel pot, while stirring with a paddle-shaped stirrer at a rate of 200 r/min. The ingredients were stabilized at 78° C., which is a temperature 4° C. higher than the cloud point of the nonionic surfactant, and an aqueous potassium hydroxide (concentration: 5% by weight) was added dropwise thereto at a rate of 9 ml/min for 11 minutes while stirring with the paddle-shaped stirrer at a rate of 200 r/min. Subsequently, deionized water was added dropwise to the mixture at a rate of 8 ml/min while stirring with the paddle-shaped stirrer at a rate of 300 r/min, totaling to an amount of 18300 g. During the addition, the temperature of the system was kept at 78° C., and a resin dispersion containing finely prepared resin C was obtained through a wire mesh having a 200 mesh screen (opening: 105 μm). The resin particles in the resulting resin dispersion had a volume-median particle size of 0.13 μm and a solid content of 20% by weight. No resin components remained on the wire mesh.

Four-hundred grams of the resulting resin dispersion and 40 g of a cyan pigment-containing aqueous dispersion (concentration: 5% by weight) were mixed in a 1 liter vessel at room temperature. Next, an aqueous solution containing a 1 g portion of calcium chloride as an aggregating agent was added to this mixture and the pH was adjusted to 6.8 with an aqueous sodium carbonate (concentration: 10% by weight). Thereafter, the mixture was stirred with a homo mixer at a rotational speed of 5000 r/min at room temperature for 1 hour. The resulting mixed dispersion was transferred to a 2 liter-four-neck flask, heated to 80° C. ($T_1$), and stirred at 100 r/min for 4.5 hours, to form aggregate particles. The aggregate particles formed had a volume-median particle size ($D_{50}$) of 4.9 μm.

Thereafter, the mixed dispersion was heated to 99° C. ($T_2$), and stirred for an additional 1 hour to unify aggregate particles. Subsequently, the mixed dispersion was subjected to a suction filtration step, a washing step, and a drying step, to give a fine colored resin particle powder. The fine colored resin particle powder had a volume-median particle size ($D_{50}$) of 5.6 μm and a water content of 0.4% by weight. The time to raise the temperature from 30° C. to $T_2$° C. was 6 hours and 10 minutes.

Subsequently, a hydrophobic silica was externally added to give a cyan toner, and the obtained cyan toner was mixed with a carrier in the same manner as in Example 1 to give a developer. The resulting cyan toner had a volume-median particle size ($D_{50}$) of 5.6 μm and a softening point of 88° C.

The resulting developer was loaded to a commercially available copying machine. When printing was carried out, an excellent image was obtained.

Example 3

Two-hundred and sixty grams of the resin C, 140 g of the resin D, 20 g of copper phthalocyanine, and 80 g of a nonionic surfactant (polyoxyethylene lauryl ether (EO=12 mol added), cloud point: 98° C., HLB value: 14.6) were melted at 150° C. in a 5 liter-stainless steel pot, while stirring with a paddle-shaped stirrer at a rate of 200 r/min. The ingredients were stabilized at 95° C., which is a temperature 3° C. lower than the cloud point of the nonionic surfactant, and 64 g of an aqueous sodium hydroxide (concentration: 5% by weight) was added dropwise thereto as a neutralizing agent, while stirring with the paddle-shaped stirrer at a rate of 200 r/min. Subsequently, deionized water was added dropwise to the mixture while stirring with the paddle-shaped stirrer at a rate of 300 r/min, totaling to an amount of 1270 g. During the addition, the temperature of the system was kept at 95° C., and a resin dispersion containing finely prepared resin A was obtained through a wire mesh having a 200 mesh screen (opening: 105 μm). The resin particles in the resulting resin dispersion had a volume-median particle size of 0.15 μm and a solid content of 31.0% by weight. No resin components remained on the wire mesh.

A 2 liter-glass separable flask was charged with 400 g of the resulting resin dispersion. Next, an aqueous solution containing 1.5 g of calcium chloride as an aggregating agent and 0.5 g of an anionic surfactant "POIZ530" (commercially available from Kao Corporation) were added to the resin dispersion and stirred at 30° C. for 10 minutes. Thereafter, deionized water was added to adjust the solid content of the mixed dispersion to 20% by weight. Here, the pH was 6.7.

Thereafter, the mixed dispersion was heated to 80° C. ($T_1$), and stirred for an additional 1 hour during heating, to aggregate pigment-containing resin particles. The aggregate particles formed had a volume-median particle size ($D_{50}$) of 4.8 μm. The mixed dispersion was then heated to 82° C. ($T_2$) over a period of 15 minutes, and stirred for an additional 1 hour during heating. Subsequently, the mixed dispersion was gradually cooled to room temperature, and subjected to a suction filtration step, a washing step, and a drying step, to give a fine colored resin particle powder. The fine colored resin particle powder had a volume-median particle size of 5.0 μm and a water content of 0.3% by weight. The time to raise the temperature from 30° C. to $T_2$° C. was 3 hours and 30 minutes.

A hydrophobic silica ("TS530," commercially available from Wacker Chemicals, number-average particle size: 8 nm) was externally added in an amount of 1.0 part by weight, based on 100 parts by weight of the fine colored resin particle powder with a Henschel mixer, to give a cyan toner. The resulting cyan toner had a volume-median particle size of 5.0 μm and a softening point of 110° C.

A developer prepared by adding silicone-coated ferrite carrier (commercially available from Kanto Denka Kogyo Co., Ltd.) having an average particle size of 60 μm to the resulting toner was loaded to a commercially available copying machine. When printing was carried out, an excellent image was obtained.

Comparative Example 1

The same procedures as in Example 1 were carried out except that 100 g of water was used instead of a nonionic surfactant, and a resin dispersion was tried to be prepared.

However, it was difficult to stir at a point where the temperature of the system was lowered to 110° C. or so because of the addition of the water used in place of the nonionic surfactant and the addition of an aqueous sodium hydroxide solution (concentration: 5% by weight), whereby consequently the resin dispersion could not be prepared.

Comparative Example 2

The resin A and methyl ethyl ketone were mixed with DISPER (commercially available from Tokushu Kika Kogyo) and a resin dispersion was tried to be prepared by adjusting a solid content of the mixture to 55% by weight. However, the resin A remained as an insoluble substance, so that the resin dispersion could not be prepared with an organic solvent.

The toner obtained according to the process of the present invention can be suitably used, for example, in development of a latent image formed in electrophotography, electrostatic recording method, electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for preparing a toner for electrophotography comprising an amorphous polyester resin binder and a colorant, said process comprising:

mixing the amorphous polyester resin binder in molten form with a liquid non-ionic surfactant and water, then preparing fine particles of the amorphous polyester resin binder having a volume-median particle size ($D_{50}$) of from 0.05 to 3 μm in an aqueous medium in the presence of the nonionic surfactant within a temperature range of from 10° C. below to 10° C. above a cloud point of the nonionic surfactant, then aggregating the fine particles to form aggregated particles, then unifying the aggregated particles to form unified particles.

2. The process according to claim 1, wherein the nonionic surfactant has an HLB value of from 12 to 18.

3. The process according to claim 1, wherein the amount of the nonionic surfactant is used in an amount of 5 parts by weight or more, based on 100 parts by weight of the resin binder.

4. The process according to claim 1, further comprising:

keeping the finely prepared polyester resin binder in the aqueous medium at least at a first temperature $T_1$° C. during the aggregating for 30 to 180 minutes and a second temperature $T_2$° C. for 30 to 180 minutes during the unifying, wherein $T_1$ and $T_2$ satisfy the following formulas (I) and (II):

$$Ts-100<T_1<Ts-5 \quad \text{(I)}$$

$$T_1<T_2\leqq T_1+20 \quad \text{(II)}$$

wherein Ts is a softening point (° C.) of the resin binder.

5. The process according to claim 4, wherein the aggregated particles formed at the termination of keeping the aggregating at $T_1$° C. have a volume-median particle size ($D_{50}$) of from 1 to 6 μm.

6. The process according to claim 4, wherein the unifying is carried out at a temperature of from 30° C. to $T_2$° C.

7. The process according to claim 1, wherein the nonionic surfactant has a cloud point of from 70° C. to 105° C.

8. The process according to claim 1, wherein the softening point (Ts) of the amorphous polyester resin binder and the cloud point (Tc) of the nonionic surfactant satisfy the relationship of Ts−30<Tc<Ts.

9. The process according to claim 1, wherein the nonionic surfactant is at least one selected from the group consisting of a polyoxyethylene glycol monolaurate, polyoxyethylene glycol monostearate, and polyoxyethylene glycol monooleate.

10. The process according to claim 1, wherein the nonionic surfactant is at least one selected from the group consisting of polyoxyethylene lauryl ether (EO=9), polyoxyethylene stearyl ether (EO=20), and polyoxyethylene lauryl ether (EO=20).

11. The process according to claim 1, wherein the toner for electrophotography is nonmagnetic.

12. The process according to claim 1, further comprising:

separating the unified particles, and washing and drying the unified particles.

13. The process according to claim 1, wherein the aggregated particles have a volume median particle size of from 4.8 to 5.1 μm.

14. The process according to claim 13, wherein the unified particles have a volume median particle of from 5.0 to 6.7 μm that is larger than the volume median particle size of the aggregated particles.

15. The process according to claim 1, wherein the aggregating is carried out at a temperature that is from 50° C. to 10° C. lower than the softening point of the amorphous polyester resin and the unifying is carried out at a temperature that is from 10° C. lower to less than the softening point of the amorphous polyester resin.

16. The process according to claim 1, wherein the amorphous polyester resin has an index of crystallinity of less than 0.6 or more than 1.5.

17. The process according to claim 1, wherein the preparing includes forming the amorphous polyester resin binder in the absence of the nonionic surfactant then mixing the amorphous polyester resin binder with the nonionic surfactant to form the fine particles of the amorphous polyester resin binder.

18. The process according to claim 1, wherein the nonionic surfactant is not a monomer unit of the amorphous polyester resin binder.

19. The process according to claim 1, wherein the mixing includes adding the water to a molten mixture comprising the amorphous polyester resin binder and the nonionic surfactant under normal pressure at a temperature equal to or lower than the boiling point of water.

20. The process according to claim 1, wherein the mixing and the preparing are carried out without an organic solvent.

21. The process according to claim 1, wherein the mixing and the preparing are carried out without separating the resin binder from the nonionic surfactant.

22. The process according to claim 1, wherein the mixing includes stirring the amorphous polyester resin binder in molten form with the nonionic surfactant to form a molten mixture, then adding water thereto.

23. The process according to claim 22, wherein during the adding of the water, the molten mixture is neutralized.

* * * * *